United States Patent [19]

Josten et al.

[11] Patent Number: 4,733,539

[45] Date of Patent: Mar. 29, 1988

[54] ICE CUBE MAKER WITH NEW FREEZE AND HARVEST CONTROL

[75] Inventors: Marvin H. Josten, Garner; Terry L. Merrill, Mason City; Kenneth W. Schneider, Mason City; Robert F. Utter, Mason City, all of Iowa

[73] Assignee: Schneider Metal Manufacturing Co., Mason City, Iowa

[21] Appl. No.: 937,931

[22] Filed: Dec. 4, 1986

[51] Int. Cl.[4] ..... F25C 1/00

[52] U.S. Cl. ..... 62/73; 62/138; 62/233

[58] Field of Search ..... 62/347, 348, 139, 233, 62/158, 138, 228.3; 340/588

[56] References Cited

U.S. PATENT DOCUMENTS

| | | | |
|---|---|---|---|
| 2,887,852 | 5/1959 | Thomas | 62/139 X |
| 3,386,258 | 6/1968 | Zygiel | 62/138 |
| 3,513,662 | 5/1970 | Golber | 62/115 |
| 3,964,270 | 6/1976 | Dwyer | 62/158 X |
| 4,238,930 | 12/1980 | Hogan et al. | 62/158 X |

*Primary Examiner*—William E. Wayner

*Attorney, Agent, or Firm*—Henry C. Kovar

[57] ABSTRACT

A method and apparatus for making ice wherein an ice cube maker has a generally upright gridded evaporator, a hot gas defrost for harvest of cubes, a storage bin below the evaporator, a hinged cube and water curtain between the evaporator and the bin, a new and improved control for the freeze cycle, and a new and improved control for the harvest cycle. The freeze cycle control has a temperature sensor, on a backside of the evaporator, circuitry to count down a predetermined time after a predetermined plate temperature has been sensed, the circuit terminates the countdown if the plate temperature exceeds the predetermined temperature and restarts the countdown when the predetermined temperature is again reached, and the circuit switches the refrigeration from freeze to hot gas defrost when the countdown is completed for harvest of the ice cubes; the harvest control has an ice curtain sensor connected to the refrigeration control, and a lever between the ice curtain and the sensor, when the curtain is opened by ice cubes the sensor picks up the lever movement and the control switches the refrigeration from the defrost to the freeze cycle.

29 Claims, 6 Drawing Figures

10
24
28
31
25
27
32
29
26
30
33
20
22
21
11
16
14
38
13
17
12
15
19

IV
10
24
28
25
27
31
32
33
26
29
30
20
22
21
11
16
38
III
III
23
19
18
P
IV

II 21
11
14
13
38
12
15
16
17

II 15
12
38
16

51
42
34
24
70
37
16,38
64
36
65
21
P
19
18
35

ICE CUBE MAKER WITH NEW FREEZE AND HARVEST CONTROL

BACKGROUND OF THE INVENTION

1. Field of the Invention

This invention pertains to a method of making ice cubes having new steps of control, and to an ice cube maker having a new and improved control for harvest and freeze cycles, and to this control for an ice cube maker.

2. The Prior Art

An ice cube maker having a vertical flat plate gridded evaporator is well known and is in extensive public use. The food and beverage retailers and in particular the fast food chains and restaurants have a significant preference for this type of ice cube maker. It is commercially accepted and in many instances preferred.

The leading example of this general type of ice cube maker is made by The Manitowoc Company, Inc. of Manitowoc, Wis., and is quite well documented in U.S. Pat. No. 3,430,452 of Mar. 4, 1969.

Another example of this type of cuber is made by Mile High Equipment Company of Denver, Colorado and is documented in U.S. Pat. No. 4,341,087 of July 27, 1982. This patent has an extensive discussion on the merits of this general type of ice cube maker.

Despite the commercial acceptance and preference for this type of ice cube maker, there have been problems with the control of the freezing and harvest cycles, amongst other things.

Typically, this type of ice cube maker will be in a freeze cycle for 8–12 minutes and will then switch to hot gas defrost to loosen the cubes from the evaporator so that the cubes can be ejected from the evaporator. Timer controls do not work well because the specific incoming water temperature, line voltages, and ambient temperatures are unpredictable. Many various schemes of control have been tried and found to still give problems.

Most recent examples of a controls for this type of machine have been developed by Manitowoc and are disclosed in U.S. Pat. No. 4,480,441 of Nov. 6, 1984 and U.S. Pat. No. 4,550,572 of Nov. 5, 1985. The first is an electro-mechanical device and is thought to be commercialized but the second device has not been seen on Manitowoc products.

Other patents having ice cube makers of this general type include: U.S. Pat. No. 3,913,349, Johnson; U.S. Pat. No. 3,964,270, Dwyer; U.S. Pat. No. 3,144,755, Kattis.

OBJECTS OF THE INVENTION

It is an object of the present invention to provide a new method of controlling the freeze and/or hot gas defrost cycles of an ice cube maker.

It is an object of the present invention to provide an improved method of making ice cubes having new steps for controlling the freezing cycle and/or the harvest cycle.

It is an object of the present invention to provide an improved ice cube maker with a new and improved control for the freezing and/or hot gas defrost cycles.

It is an object of the present invention to provide a new and improved control for the freezing and/or hot gas defrost cycles of an ice cube maker.

It is an object of the present invention to provide an ice cube maker with an improved freeze cycle control.

It is an object of the present invention to provide a new method of and an apparatus for making ice cubes that provide very high levels of reliability, low cost, relatively simple diagnosis and repair, and which will work in all ambients and with all waters.

These and other advantages, features and objects of this invention will become manifest to those versed in the art upon review and study of the teachings herein.

SUMMARY OF THE INVENTION

According to the principles of the present invention, a method of making ice cubes has the steps of sensing the size of frozen ice, initiating hot gas defrost upon sensing of a predetermined ice size, dropping the ice off an evaporator and against an ice curtain, opening the curtain with the ice, changing the mode of a curtain sensor with the ice, and terminating the defrost in response to the mode changing.

A further method of making ice cubes has the steps of initiating a freeze cycle while flowing water over an evaporator plate, sensing the plate temperature, starting a countdown upon sensing a predetermined plate temperature, counting down as long as the plate temperature is at or below the predetermined temperature, terminating the countdown if the sensed temperature goes above the predetermined temperature, and terminating the freeze cycle upon completion of the countdown.

An ice cube maker harvest control has structure for sensing ice thickness, a movably mounted ice curtain disposed between an evaporator and an ice bin, a curtain sensor connected to structure for initiating a freeze cycle, a flag movable by the curtain in a path past the curtain sensor, and a mechanism between the curtain and the flag for multiplying the movement of the curtain.

An ice cube maker with an improved freeze cycle control has an evaporator plate for freezing ice, a temperature sensor on the back of the plate, a refrigerant valve for supplying cold or hot refrigerant to the plate, a freeze cycle control connected to the sensor and the valve; the control has structure for determining the plate temperature, counting down once a predetermined temperature has been reached, terminating the countdown if the plate goes above the predetermined temperature, and for switching the ice maker from freezing to defrost upon completion of the countdown to harvest the ice.

An ice cube maker with a generally vertical flat plate gridded evaporator, a bin under the evaporator, and an ice thickness sensor, has an improved control for the freeze and harvest cycles with a pivotally mounted ice curtain between the evaporator and the bin, discrete structure for sensing an opening of the curtain by falling ice from the evaporator, and a control which restarts the freezing cycle when it has been sensed that the curtain was opened by falling ice.

AS SHOWN IN THE DRAWINGS

Figure 2:
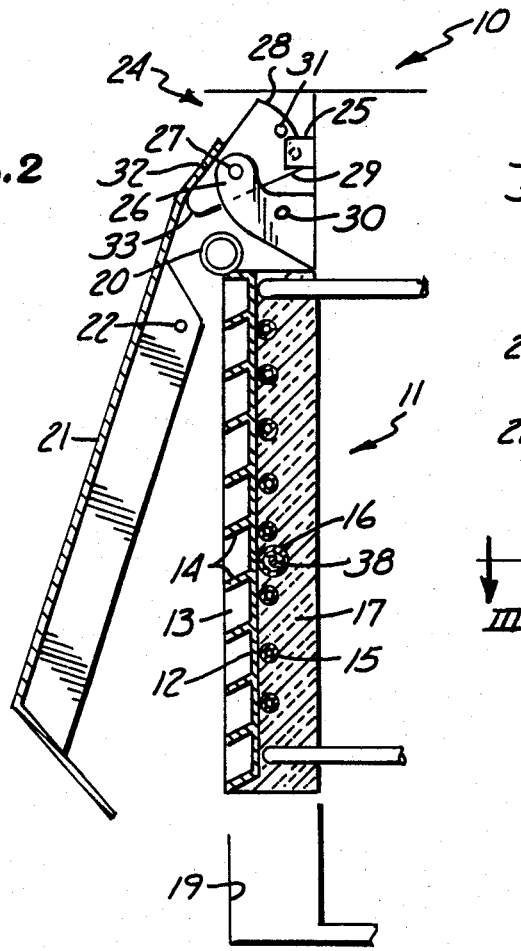
FIG. 2 is a similar elevational side view of the evaporator and ice curtain componentry of the structure of FIG. 1 with the curtain open.
Figure 1:
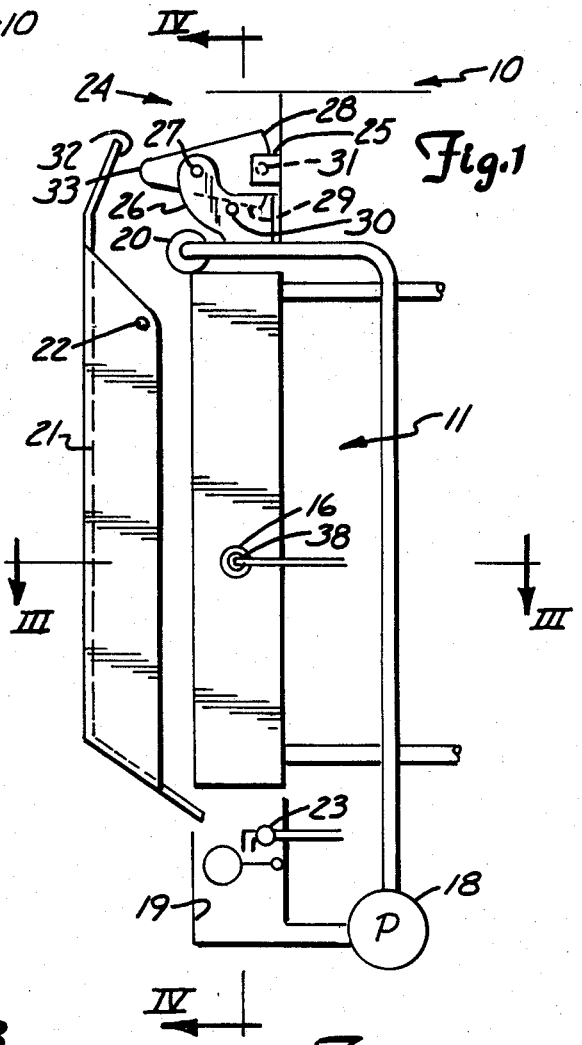
FIG. 1 is an elevational sideview, in partial section, showing the preferred embodiment of the ice cube maker of the present invention.
Figure 3:
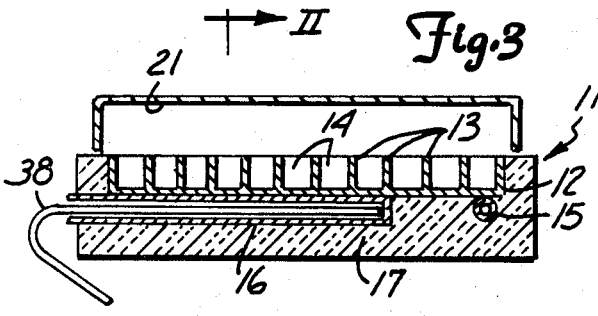
FIG. 3 is a downward looking sectional view through lines III—III of FIG. 1.
Figure 4:
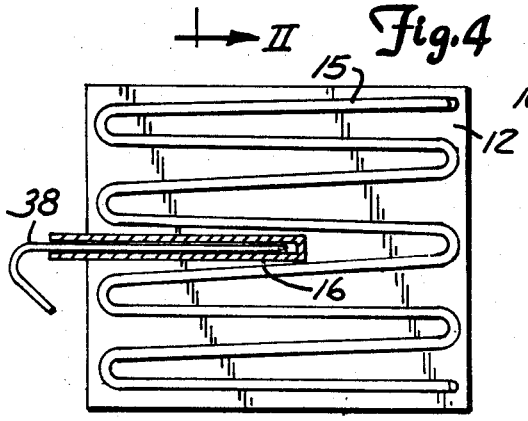
FIG. 4 is an elevational sectional view through lines IV—IV of FIG. 1.
Figure 5:
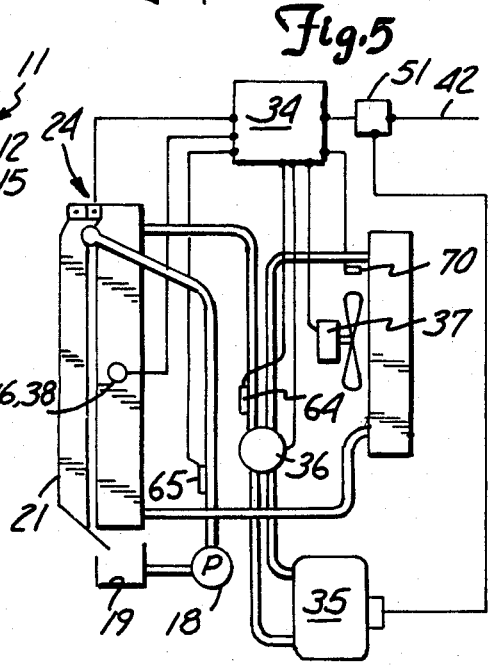
FIG. 5 is a schematic of the ice maker refrigeration system.

The principles of the present invention are embodied in and practiced with the preferred embodiment of an ice cube maker such as is shown in FIGS. 1 & 2 and which is generally indicated by the numeral 10.

The ice maker 10 has an evaporator generally indicated by the numeral 11 which preferably has a freezing plate 12 made of a generally vertical flat metal plate having top, bottom and side flanges and an internal egg crate type matrix with vertical dividers 13 and horizontal dividers 14 dividing the freeze plate 12 into small discrete pockets for the freezing of discrete cubes. On the rear side of the freeze plate 12 is a refrigerant coil 15 which is appropriately serpentined on and over the plate 12. A temperature thermister well 16 is soldered to the rear side of the freeze plate 12 just above the vertical mid point of and on one transverse side of the freeze plate 12. The refrigerant coil 15 and thermister well 16 are spaced from each other and are both thermally enclosed within a backing of thermal insulation 17. A circulation pump 18 for the water to be frozen into ice cubes has an inlet line from a water catching reservoir 19 and an outlet line to a distributor manifold 20 mounted on the top of the evaporator 11. A movable evaporator curtain 21 is pivotally suspended from a horizontal axis fulcrum 22. The curtain 21 and fulcrum 22 are in front of the evaporator 11 and the fulcrum 22 is adjacent to and above a mid level of the evaporator 11. The curtain 21 is normally closed during freezing of ice, as is shown in FIG. 1, and the curtain 21 is opened by falling ice during harvest as is shown in FIG. 2. The curtain 21 retains falling water upon the freeze plate 12, and during circulation of water over the freeze plate 12 during freezing of ice the curtain 21 directs the falling water into the reservoir 19 from which the pump 18 continually recirculates the water over the freeze plate 12 during the freeze cycle. At the start of a freeze cycle, the reservoir 19 is filled with water and the fill level is controlled by a float valve 23. The pump 18 is turned on and water from the reservoir 19 is then continuously circulated through the manifold 20 and from there downwardly by gravity over the freeze plate 12. The curtain 21 confines the falling water and directs it back into the reservoir 19. When freezing of ice is completed, the ice maker 10 switches into hot gas defrost and releases the frozen ice from the freeze plate 12. The frozen ice looks like a waffle with individual discrete cubes being attached to each other by a thin sheet of ice frozen over the outer edges of the dividers 13, 14. The falling ice forces the curtain 21 to open and the ice falls past the water reservoir 19 and into an ice bin (not shown) below the reservoir 19. The waffle ice sheet then breaks up leaving discrete cubes.

An important feature of this invention is the curtain position sensor generally indicated by the numeral 24. Movement and position of the curtain 21 are sensed and utilized to control shut-off of the ice maker 10 when the bin is full of ice cubes, and to restart the freeze cycle upon completion of a harvest of ice cubes. The curtain position sensor 24 is mounted to the ice maker 10 above the curtain 21, and the freeze plate 12 and the water manifold 20 whereby the position sensor 24 is isolated from and spaced above the moving water and ice. The curtain position sensor 24 has an electronic curtain sensor 25 which is preferably an integral U-shaped photo electric emitter and receiver (PER) having a constantly energized emitter. The sensor 25, a sensor bracket 26 and a flag fulcrum 27 are mounted to the ice maker and fixed with respect to the evaporator 11 and the curtain fulcrum 22. A movable sensor flag 28, which is preferably a first class lever, is pivotally mounted in the sensor fulcrum 27. The flag 28 is freely pivotable and is a flat piece of sheet metal having a weight 29 which by gravity biases the flag clockwise as shown in FIGS. 1 & 2 into normal abuttment against a flag stop 30 on the bracket 26. The flag 28 has a small precisely located open sensor aperture 31 which normally is precisely registered with and which is between the emitter and the receiver of the sensor 25. The sensor aperture 31 is within the flag 28, and the aperture 31 and weight 29 jointly form a precision shutter for momentary obstruction of the beam from the emitter to the receiver of the sensor 25. The curtain 21 has a sensor cam 32 which contacts against and drives a cam follower 33 on the flag 28. The cam 32 is normally spaced from and does not contact the follower 38 and has a lost motion connection which enables the curtain 21 to flop around without effecting the sensor 25. When the ice maker 10 is freezing ice, the curtain 21 is closed as shown in FIG. 1 and the sensor 25 is normally transmitting from its emitter to its receiver through the flag sensor aperture 31. When the ice maker 10 releases its cubes from the freeze plate 12, the cubes fall down and force the curtain 21 open as shown in FIG. 2. When the curtain 21 opens, the curtain cam 32 contacts the follower 33 and cams the flag 28 counterclockwise to the alternative position shown in FIG. 2. As soon as the flag sensor aperture 31 is lifted, the opaque flag 28 obstructs the beam of the sensor 25 and the sensor provides a signal indicative of this obstruction to an ice maker control 34. The control 34 then makes the assumption that cubes are being harvested. After the ice falls past the curtain 21, the curtain 21 recloses by gravity and the flag 28 is released and it returns to its normal position whereupon the beam of the sensor 25 again becomes normally transmitted. When the beam is broken during opening of the curtain 21, the refrigeration system is immediately switched from hot gas defrost to cooling. If the ice bin has been filled with cubes, the harvest will not fall completely past the curtain 21 and the curtain 21 will be held open. When this happens the beam of the sensor 25 is obstructed for an abnormally long time period and if transmission of the beam is not re-established, the ice maker 10 deduces it has filled its storage bin and it shuts itself off. A self-resetting curtain timer 40 receives the signal that the curtain 21 is open and if the curtain 21 stays open for an excessive period of time, the timer 40 provides a signal to shut down the compressor 35 and other componentry. The timer 40 will provide a turn-off signal after the curtain 21 has been open too long. When the ice level in the bin falls and the curtain 21 closes and transmission of the beam of the sensor 25 is re-established, the ice maker 10 automatically starts itself. The entire curtain position sensor 24 is well above both the water and ice and is not subject to contact with the water or ice. The position sensor 24 is also located far above the storage bin and it will operate regardless of what configuration of storage bin is utilized. The sensor 24 also works on very low signal voltage and current and does not bring any type of a potentially hazardous electrical potential into the ice making and storage chambers. This sensor 24 has no springs and nothing to wear out or break. It is extremely reliable, low cost, and accessible and is easily understood by people who own, operate, repair or rely upon the ice maker 10. What electrical potential and signals are provided or made by the sensor 25, are completely isolated from contact with either ice or water. The termination of hot gas defrost function and the function of shut-off when the storage bin is filled are responsive to a clear made change of the sensor 25 from transmitting to obstructed and vice-versa. The lost motion connection between the curtain 21 and flag 28 enables the curtain 21 to partially move without signaling ice release when the ice cubes have only partially released from the freeze plate 12. The ice maker 10 waits for the harvest completion signal until the complete sheet of ice and cubes falls off of the freeze plate 12 and substantially opens the curtain 21.

As an example, the curtain 21 will open 5 to 10 degrees before the cam 32 engages the follower 33. The curtain 21 will then, upon dropping of the ice sheet, open a total of about 20 degrees and in the last 10 degrees of travel the flag 28 will be turned about 30 degrees. The angular mechanical motion amplification between the curtain 21 and flag 28 is at least 2:1 and preferably about 3:1 as soon as the cam 32 and follower 33 engage each other. During the mode changes from freeze to defrost and back to freeze, the compressor 35 runs continuously and there is no stop or start which greatly enhances compressor life and control component life as well as providing for increased thermal efficiency and ice production.

Another important improvement in this ice maker 10 is a new freeze control, previously identified in general by the numeral 34. The control 34 is responsive to the curtain position sensor 24 and is connected to control the water circulation pump 18, the refrigeration compressor 35, the hot gas defrost valve 36, the condensor fan 37, and other componentry as will be further described. A freeze plate temperature sensing thermister 38 is mounted in the freeze plate thermister well 16 and is operatively connected to the control 34. Within the control 34 is a self-resetting refrigeration delay timer 39, which may have either a fixed or variable delay as circumstances dictate. During freezing of ice on the freeze plate 12, the thermister 38 will electronically indicate the temperature of the freeze plate 12. The freeze plate 12 temperature has been determined to be analogous to the size of ice as a function of the thickness of the ice upon the freezing plate 12 of the evaporator 11. When the thermister 38 indicates the plate 12 temperature to be at or below a predetermined temperature, the delay timer 39 is started. If the indicated temperature remains at or below the predetermined temperature for the delay timer period, the timer 39 will complete a countdown of the delay time period and upon completion of the coundown the timer 39 will provide a signal that freezing of a batch of ice cubes has been completed. The control 34 will then switch the ice maker 10 into hot gas defrost for harvest of the ice. If during the freeze cycle, the temperature indicated by the thermister 38 merely momentarily dips down to or goes below the predetermined temperature and then returns to above the predetermined temperature, the timer 39 terminates its countdown upon the indicated temperature rising above the predetermined temperature and the timer 39 then discharges and resets itself to relative zero. When the temperature of the freeze plate 12 subsequently falls to the predetermined temperature, the countdown will again be started. This start, terminate, erase or reset, and restart of the countdown can be done as many times as needed. Typically and usually, it will be done only once. When the termination and reset is done, false harvests of incomplete ice are prevented.

A predetermined temperature in the range of 2–12 degrees Fahrenheit (−17 to −11 degrees Celsius) or 7±5 degrees Fahrenheit (−14±3 degrees Celsius) has been found to be indicative of the proper size and quantity and thickness of ice upon the freeze plate 12 for complete harvest of a proper quantity of properly completed and sized ice cubes. A countdown time period in the range of 20–30 seconds has been found to prevent false or improper harvests of ice. The freeze cycle of the refrigeration system continues without interruption during the countdown period and the hot gas defrost is initiated immediately upon completion of the countdown.

The water pump 18 and water circulation over the freeze plate 12 are continued during the countdown. Upon completion of the countdown, the pump 18 and water circulation are immediately shut down and terminated concurrent with start of the hot gas defrost. The ice on the freeze plate 12 is thereby prevented from excessive sub-cool and the ice is released from the freeze plate 12 in the shortest possible time. The hot gas defrost start and the termination of the water flow over the freeze plate 12 are both done immediately upon completion of the countdown.

Figure 6:
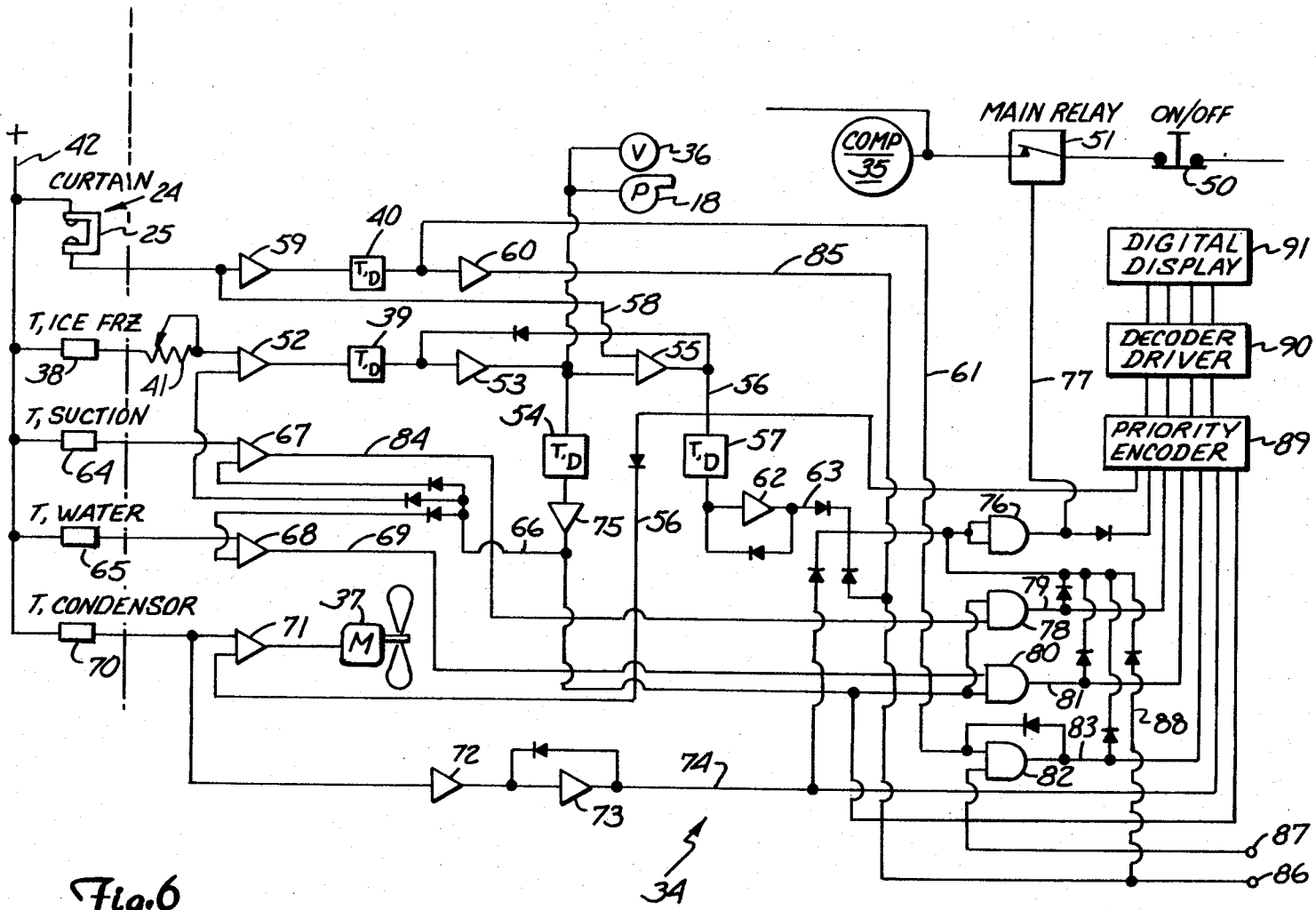
FIG. 6 is a logic diagram for the electrical control of the ice cube maker of FIG's 1 and 5.

FIG. 6 has a logic diagram of the ice maker control 34. Line power for the ice maker 10 comes in through a manually operable on/off switch 50 and through a main relay 51 to the compressor 35 and other operating components. Low voltage DC power for the control 34 and sensor 25 comes in line 42 and is taken off line power before the on/off switch 50. The signal from the freeze plate thermister 38 is fed through an adjustable potentiometer 41 and then through an amplifier 52 to the refrigeration delay timer 39. The timer 39 as previously described, has a countdown period of about 20–30 seconds. Start of the countdown period can be adjusted with the potentiometer 41 to give larger or smaller ice cubes. Upon completion of its countdown, the timer 39 sends its signal to a harvest amplifier 53. The harvest amplifier 53 sends its signal to the hot gas defrost 36 and the water pump 18, to a control turn-on timer 54, and to a latching interlock amplifer 55. The signal to the hot gas defrost 36 simultaneously turns on the hot gas defrost 36 and turns off the water circulation pump 18. The interlock amplifier 55 feeds a signal out a signal line 56 to a harvest period timer 57. When the amplifier 53 and interlock 55 are latched, the hot gas defrost 36 is on and the water pump 18 is off.

The signal from harvest amplifier 53 to the control timer 54 disables the timer 54 and the control amplifier 75 whereupon via signal line 66 an appropriate signal is provided to immediately disable the freeze plate temperature amplifier 52, a suction line temperature amplifier 67 and a water temperature amplifier 68 so that the control 34 does not receive signals from amplifiers 52, 67 or 68 during hot gas defrost and during initial pull-down of the subsequent freezing cycle as will be described.

When the curtain 21 is subsequently opened by falling ice, the curtain sensor 25 sends its signal that the curtain 21 has opened via signal line 58 to simultaneously unlatch the harvest amplifier 53 and the interlock amplifier 55. Immediately the hot gas defrost 36 is turned off and the pump 18 restarted and a subsequent freeze cycle is started. The signal that the curtain 21 has opened is also sent from the curtain amplifier 59 to the curtain timer 40. If the signal to the curtain timer 40 is provided for a length of time in excess of the timer 40 preset period, the curtain timer 40 sends an output signal to a full bin amplifier 60 which then provides a signal via signal line 85 to turn off the refrigeration as will subsequently be described.

The harvest period timer 57 is started simultaneously with the hot gas defrost 36. The harvest period timer 57 will have a predetermined countdown period, with a 4½ minute countdown period being an appropriate example. The curtain timer 57 will countdown if the curtain 21 does not open and upon completion of a countdown will indicate no harvest or a faulty harvest and that something is wrong with the ice maker 10. Upon completion of a countdown, the harvest period timer 57 will send a signal to latch a faulty harvest amplifier 62 which in turn will send a signal out signal line 63 to shut off the refrigeration.

When the signal from the harvest amplifier 53 is changed upon start of the next freeze cycle, the control timer 54 is started. The control timer 54 has a countdown period that is greater than the initial pulldown time of the refrigeration system and greater than the time it takes to begin freezing ice on the freeze plate 12. The control timer 54 countdown time will preferably be more than one-half of the time it takes to complete freezing of a normal cycle of ice cubes. A preferred and an example time for countdown of the control timer 54 is about six minutes. When the control timer 54 has completed its countdown, it sends out signals by its control amplifier 75 and signal lines 66 that simultaneously enable thermister amplifiers 52, 67 & 68 and therefore the thermisters 38, 64 & 65. If the suction line temperature is too high, specifically greater than forty degrees Fahrenheit, a signal will then be sent by suction line thermister 64 and suction line amplifier 67 via signal line 84 to shut down the ice maker 10. The water temperature thermister 65 is positioned to sense and indicate the temperature of the water being circulated over the freeze plate 12 by the pump 18. If the indicated water temperature is then too high, for example greater than 45 degrees Fahrenheit, the water thermister 65 and water temperature amplifier 68 will send a signal via signal line 69 to cause shutdown of the ice maker 10. The amplifiers 52, 67 & 68 are disabled during hot gas defrost and pulldown, and are then enabled by the control timer 54 and amplifier 75 after the refrigeration system has stabilized in a freeze cycle.

A refrigeration condensor temperature thermister 70 senses and indicates condensor temperature to a pair of condensor amplifiers 71, 72. The first condensor amplifier 71 is operatively connected to send a signal to turn off the condensor fan 37 if and when the condensor is too cold. The output signal line 56 of the harvest cycle latching interlock 55 is also connected to an input of the first condensor amplifier 71 so that a signal to go into hot gas defrost also turns off the condensor fan 37 and keeps the fan 37 turned off during hot gas defrost. The second condensor amplifier 72 discretely sends a signal to latching condensor amplifier 73 which in turn sends a signal via signal line 74 to shut down the ice maker 10 when the condensor temperature is too hot. The first condensor amplifier 71 will, as an example, keep the condensor fan 37 turned off if the condensor temperature is too low. When the condensor temperature goes above 105 degrees Fahrenheit, the first amplifier 71 will cause the condensor fan 37 to turn on; and when the condensor temperature drops to below 85 degrees Fahrenheit, the first amplifier 71 will cause the condensor fan 37 to turn off. The second condensor amplifier 72 will shut down the ice maker when the condensor temperature reaches 155 degrees Fahrenheit; such a high temperature is indicative of a dirty condensor, fan motor failure, fan jammed, or plugged air inlet.

A shut down inverter 76 has an output signal line 77 operatively connected to open the main relay 51 and disable the compressor 35 and other operating components of the ice maker 10. The shut down inverter 76 inputs are connected with OR logic wherein any single input will effect shut down of the ice maker 10. A shut down signal from curtain timer 40 via signal line 85, or faulty harvest amplifier 62 via line 63, or in condensor temperature signal line 74 will cause shut down inverter 76 to open the relay 51. The suction temperature signal line 84 is connected into suction temperature inverter 78. If the suction temperature is too high, for example above 40 degrees Fahrenheit, and the suction amplifier 67 has been enabled, something is wrong and a signal will be sent to the suction inverter 78 which in turn will send a shut down disable signal via signal line 79 to the shut down inverter 76.

The water temperature signal line 69 sends a signal after the water temperature amplifier 68 has been enabled, and when the water is too warm to water temperature inverter 80 which in turn sends a disabled signal to the shut off inverter 76 via signal line 81.

If the curtain 21 failed to close, the signal in line 61 is sent to a multiple ice maker full bin inverter 82, the signal from the full bin amplifier 60 is sent via signal line 85 and signal line 88 to the shut down inverter 76 for causing shut down of the refrigeration until the curtain 21 reopens. The curtain open signal is also sent via signal line 85 and connector pin 86 to any upper level ice makers (not shown) atop of the subject ice maker 10. An upper level ice maker will eventually return an upper curtain open signal via connector pin and signal line 87 to full bin inverter 82 which in turn sends a shut down signal via line 83 to the shut down inverter 76 which will effect a shut down of the subject ice maker 10 and all upper level ice makers.

Thus, a disable signal in any one of signal lines 63, 74, 79, 81, 83, 85, or 88 will cause the shut down inverter 76 to open the relay 51 and stop the compressor 35. The outputs of the inverters 76, 78, 80, 82, the condensor latching amplifier 73, the control amplifier 75, and the interlock amplifier 55 are all discretely connected to a priority encoder 89 which has its outputs connected to a decoder driver 90 which has its outputs connected to a status display 91 preferably of the digital LED type.

The status display 91 gives a visual indication of what the ice maker 10 is doing, and why. For example, the following read outs indicate the following.

| INDICATED STATUS NUMBERS | EXPLANATION | POSSIBLE CAUSE |
|---|---|---|
| 0 | Unit is in freeze cycle, making ice, no problems. | |
| 1 | Unit is in harvest cycle, ice should drop shortly, no problems. | |
| 2 | Normally indicates a full bin condition, unit off, water curtain being held open with ice. | If "2" is shown but bin isn't full, check for individual cube holding curtain open. |
| 3 | Unit off due to circulating water temperature not pulling down to at least 45° F. Manual reset required. | Incoming water shut off. Pump not running or plugged. Reservoir leaking badly. Water level set too high causing premature syphoning. Sensor not insulated properly. Defective sensor. |
| 4 | Unit off due to suction line not pulling down to at least 40° F. Manual reset required. | Low on refrigerant. Defective refrigerant valve. Compressor defective or inefficient. Defective power relay, won't close. Defective start relay, won't start compressor. Low voltage to compressor, no start. Defective compressor valve. Defective sensor. Sensor not insulated properly. |
| 5 | Unit off due to ice not releasing from evaporator within four minutes after entering harvest cycle. Manual reset required. | Water curtain jammed and won't swing open. Defective hot gas valve, won't open, plugged. Ice slab deformed, won't release properly. Extremely low ambient temperature, below 45° F. |
| 6 | Unit is off due to condensor temperature climbing too high. Manual reset required. | Dirty condensor. Defective fan motor or blade. Gross overcharge. Extremely high ambient temperature, above 120° F. Defective sensor. |
| Decimal point OFF | Indicates that all sensors, except condensor, are switched off for first six minutes of freeze cycle. | Normal time delay, approximately 6 minutes. |
| Decimal point ON | Indicates all sensors have been switched on. | |
| Decimal point FLASHING | Indicates evaporator temperature has pulled down and unit will go into harvest after time delay. | Normal time delay of approximately 20 seconds before harvest cycle begins. |

If and when manual reset is required, the master switch 50 must be turned off for 10 seconds and then returned to "ON".

This new and improved ice maker 10 is extremely reliable and commercially effective. It is relatively simple and fool proof. It reliably harvests ice cubes and reliably starts and/or shuts itself off. When something is wrong it stops before destroying itself and it indicates what's wrong.

Although other advantages may be found and realized and various modifications may be suggested by those versed in the art, it should be understood that we wish to embody within the scope of the patent warranted hereon, all such embodiments as reasonably and properly come within the scope of our contributions to the art.

We claim as our Invention:

1. A method of making ice cubes, comprising the steps of (a) sensing the size of ice frozen upon an evaporator;
(b) initiating a hot gas defrost of the evaporator upon the sensing of a predetermined size of ice, and thereby and thereafter harvesting the ice from the evaporator;
(c) dropping the ice off of the evaporator and against a curtain;
(d) opening the curtain with the dropping ice;
(e) changing the mode of a photoelectric emitter-receiver with the curtain during said opening; and
(f) terminating the hot gas defrost and restarting a freeze cycle in response to the mode changing, and freezing a subsequent quantity of ice.

2. The method of claim 1, in which the step of sensing includes the sensing of the temperature of the evaporator freezing surface.

3. The method of claim 2, in which the freezing surface temperature is sensed at a mid level location on one side of the evaporator.

4. The method of claim 2, in which the hot gas defrost is initiated when a freezing surface temperature in the range of 2 to 12 degrees F. (−17 to −11 degrees C.) is sensed.

5. The method of claim 1, including the step of amplifying the movement of the curtain, with respect to the emitter-receiver.

6. The method of claim 1, in which the step of mode changing comprises obstructing a normally transmitted beam between the emitter and the receiver.

7. The method of claim 1, in which the mode changing is done above the evaporator and the ice.

8. The method of claim 5, including firstly partially opening the curtain with the ice without effecting the mode, and then secondly effecting the mode change with said amplification to very rapidly effect the mode change.

9. The method of claim 1, including the further steps of counting down after the predetermined size of ice has been sensed as a function of evaporator temperature, completing the countdown and then initiating the hot gas defrost, and resetting the countdown.

10. A method of making ice cubes, comprising the steps of:

(a) initiating a freeze cycle and supplying cooled refrigerant to a refrigerant circuit on an evaporator plate while flowing a film of water firstly over the plate and then subsequently over ice formed upon the plate;

(b) sensing the temperature of the evaporator plate;

(c) starting a countdown of a predetermined time upon sensing that the plate is at a predetermined temperature, said temperature being below the freezing point of water and being indicative of a predetermined thickness of ice upon the plate;

(d) counting down the time as long as the sensed temperature remains at or below the predetermined temperature;

(e) terminating the countdown if the temperature rises above the predetermined temperature;

(f) restarting a subsequent countdown when the sensed temperature again falls to the predetermined temperature;

(g) terminating the freeze cycle and initiating a hot gas defrost cycle upon completion of a countdown; and (h) terminating the freeze cycle and initiating a subsequent freeze cycle upon sensing that ice falling off of the evaporator plate has opened a curtain between the plate and a storage bin.

11. The method of claim 10, in which said predetermined temperature is 7±5 degrees F. (−4±3 degrees C.).

12. The method of claim 10, in which the time of said countdown is in the range of 20–30 seconds.

13. The method of claim 10,, in which the freeze cycle continues uninterrupted until countdown completion.

14. The method of claim 10, in which the hot gas defrost is initiated immediately upon countdown completion.

15. The method of claim 14, including the further step of continuing the flow of water over the plate ice during the countdown, and then terminating the flow of circulating water at the conclusion of the countdown.

16. The method of claim 10, in which the countdown is completely repeated after a restart.

17. An ice cube maker having an improved freeze cycle control, comprising:

(a) an evaporator plate having a front side for freezing ice and a back side with a refrigerant circuit thereon;

(b) a temperature sensing thermister on the plate back side;

(c) a refrigerant valve operatively connected to reverse refrigerant flow to the plate from a normal freezing cycle to a hot gas defrost cycle for release of and harvest of ice frozen upon the plate;

(d) a freeze cycle control operatively connected to the thermister and to the refrigerant valve;

(e) means in said control for (1) determining via the thermister that the plate temperature has fallen to a predetermined temperature, (2) counting down a predetermined time after the predetermined temperature has been sensed, (3) terminating the countdown if the sensed temperature goes above the predetermined temperature, and (4) switching the ice maker from the freeze cycle to the defrost cycle upon countdown completion for harvest of the frozen ice;

(f) means for switching the ice maker from the defrost cycle to a freeze cycle, and (g) a curtain positioned between the plate and a storage bin, said switching means being responsive to opening of said curtain by ice falling off of the evaporator plate.

18. An ice cube maker according to claim 17, including means for completely resetting the countdown means during a countdown termination or the defrost cycle.

19. An ice cube maker according to claim 7, including means for adjusting the start of the countdown.

20. An ice cube maker according to claim 17, in which the thermister is spaced from the refrigerant circuit.

21. An ice maker comprising of:

(a) means for sensing the thickness of ice on a freezing evaporator, said sensing means being operatively connected to means for initiating a hot gas defrost harvest cycle upon the sensing of a predetermined thickness;

(b) a movably mounted curtain disposed in between the evaporator and an ice storage bin, said curtain being movable by ice falling off of the evaporator;

(c) a curtain sensor operatively connected to means for initiating a freeze cycle;

(d) a flag operatively connected to and which is movable by the curtain in a path past the curtain sensor for causing the curtain sensor to give a signal for initiating the freeze cycle; and (e) a mechanism between the curtain and the flag for multiplying the movement of the flag with respect to the curtain, so that the flag has an amplified movement when the curtain is opened by ice falling off of the evaporator.

22. The apparatus of claim 21, wherein said ice sensing means is a thermister on a rear side of the evaporator.

23. The apparatus of claim 22, wherein said thermister is in a well secured to the evaporator rear side, at mid height on one side of the evaporator, said well having an open end facing outward and said thermister being fed into the well through the open end.

24. The apparatus of claim 21, in which the curtain is pivotally mounted with respect to the evaporator adjacent to and above a mid level of the evaporator and the curtain.

25. The apparatus of claim 21, in which the curtain sensor and flag are mounted above the evaporator.

26. The apparatus of claim 21, in which the curtain sensor is fixed with respect to the evaporator, the curtain is pivotable with respect to the evaporator, and the flag is movably mounted upon a fulcrum fixed with respect to the evaporator.

27. The apparatus of claim 26, in which the flag is a first class lever, a fulcrum of the flag being in front of the curtain sensor.

28. The apparatus of claim 27, including a cam follower on an end of the flag, and a cam on the curtain for engaging the cam follower and operating the flag.

29. The apparatus of claim 28, including a lost motion connection between the curtain and the flag.

* * * * *